US006146289A

United States Patent [19]

Miller et al.

[11] Patent Number: 6,146,289

[45] **Date of Patent: *Nov. 14, 2000**

[54] POWERED MOVABLE HITTING TEE

[76] Inventors: Joseph M. Miller, 9109 Volunteer Dr.; Dillon Lee, 8126 Keeler St.; Michael C. Porter, 8110 Orville St., all of Alexandria, Va. 22309

[ * ] Notice: This patent is subject to a terminal disclaimer.

[21] Appl. No.: 09/209,001

[22] Filed: Dec. 11, 1998

Related U.S. Application Data

[63] Continuation-in-part of application No. 09/002,377, Jan. 2, 1998, Pat. No. 5,848,945

[60] Provisional application No. 60/034,605, Jan. 3, 1997.

[51] Int. Cl.[7] ..... A63B 69/40

[52] U.S. Cl. ..... 473/417

[58] Field of Search ..... 473/417, 422, 473/451, FOR 103

[56] References Cited

U.S. PATENT DOCUMENTS

| | | |
|---|---|---|
| 3,489,411 | 1/1970 | Morelli et al. . |
| 4,575,080 | 3/1986 | Miles . |
| 4,989,866 | 2/1991 | Dill . |
| 4,993,708 | 2/1991 | Prosser et al. . |
| 5,004,234 | 4/1991 | Hollis . |
| 5,076,580 | 12/1991 | Lang . |
| 5,386,987 | 2/1995 | Rodino, Jr. . |
| 5,388,823 | 2/1995 | Prieto . |
| 5,393,050 | 2/1995 | Lloyd . |
| 5,478,070 | 12/1995 | Morrison . |
| 5,662,536 | 9/1997 | Martinez . |
| 5,848,945 | 12/1998 | Miller et al. . |

FOREIGN PATENT DOCUMENTS

| | | |
|---|---|---|
| 278321 | 9/1922 | Japan . |
| 502298 | 1/1975 | Japan . |

*Primary Examiner*—Raleigh W. Chiu

*Attorney, Agent, or Firm*—Shinjyu Global IP Counselors, LLP

[57] ABSTRACT

The powered, moveable hitting tee of the instant invention is basically made up of a vertical tee, a reciprocating, horizontally disposed rod supporting the vertical tee, and a drive assembly or mechanism that is coupled to horizontally disposed rod to move the vertical tee towards the player. A moveable sled or carriage assembly movably supports the horizontally disposed rod. In one embodiment, a motor and pulley assembly is used for rotating a drive belt, which in turn moves the sled, the rod and the vertical tee. In another embodiment, a chain drive is used for moving the sled, the rod and the vertical tee. In another embodiment, a lead screw is used for moving the sled, the rod and the vertical tee. The particular structure that moves the vertical tee is not critical to the basic concept of the present invention. Rather, it will be apparent from this disclosure that various drive mechanisms can be made used to move the vertical tee towards the player. The vertical tee may include a rather rigid lower segment and a somewhat flexible upper segment made of memory-retentive material, which will bend but not be damaged when struck accidentally by a bat. The upper end of vertical tee upper segment may be flared to support a baseball or softball. In one embodiment, the tee support includes a coil spring as a shock absorber. A removable motor assembly and remote control devices may also be included.

21 Claims, 7 Drawing Sheets

POWERED MOVABLE HITTING TEE

CROSS-REFERENCE TO RELATED APPLICATION

This application is a continuation-in-part application of U.S. patent application Ser. No. 09/002,377, filed Jan. 2, 1998, now U.S. Pat No. 5,848,945, which in turn claims the benefit of U.S. Provisional Patent Application Ser. No. 60/034,605, filed Jan. 3, 1997. The entire disclosure of U.S. patent application Ser. No. 09/002,377 is hereby incorporated herein by reference.

BACKGROUND OF THE INVENTION

1. Field of the Invention

The present invention generally relates to training devices for hitting a moving ball, e.g., baseballs, softballs, tennis balls. More specifically, the present invention relates to a portable, powered, moving hitting tee, which helps to train a novice hitter, especially, to keep his or her eye "on the ball." The invention has particular use in training youngsters to hit the ball with a bat or other hitting device while the ball moves toward them, slowly, so that hand-eye coordination may be developed. Of course, the invention has utility during any regular hitting practice as well.

2. Description of the Prior Art

The prior art is replete with examples of hitting tees, but none which move in the manner of the instant invention and are powered to move in a preplanned manner. Rather, the prior art only discloses batting tees wherein the position of the ball to be struck by a bat may be adjustable to a number of positions. With one somewhat relevant exception, there are no teachings in the art of a batting tee wherein the ball while supported by the tee is actually moved by the batting tee into a strike zone just before it is struck, this being the essence of the present invention.

The exception just noted appears in U.S. Pat. No. 4,575,080, issued Mar. 11, 1986 to Michael E. Miles. This patent teaches a batting tee assembly including a blower creating an air stream for suspension of a baseball. The baseball may be oscillated vertically and/or moved in a circular fashion by the tee, which also includes angled outlets below the top of the tee, for rotating the tee and thus the ball as it remains air-suspended. Thus, the machine provides simulation of the rising, falling and curving motions of a baseball as it approaches the batter. This patent does not teach, however, tee-supported movement of the baseball into the strike zone, the ball remaining in contact with and supported by the tee as it moves toward the batter. Furthermore, a blower assembly, with its attendant noise distraction and power requirement characteristics, is not needed in the present invention.

Batting tees for supporting a ball in a stationary position are well known. A publication entitled "How to Make a Batting Tee" teaches one to secure a length of radiator hose over a section of water pipe, and insert the pipe into a plywood base shaped as a home plate. The device may be sand-weighted for stability and the home plate my be drilled at numerous location for insertion of the pipe segment, at various places on the home plate, to simulate a number of ball locations, all in the strike zone. The baseball is positioned on top of the radiator hose segment. Again, the basic batting tee including a vertical post, an upper, flexible ball support, and a weighted base which may be configured as a home plate is well known. A toy-like version of a batting tee called "TeeBall" complete with metal tee, and plastic ball and bat, has been marketed in the past.

U.S. Pat. No. 5,388,823 issued Feb. 14, 1995, to Ronald G. Prieto is representative of a number of prior art teachings of batting tees, wherein adjustable positioning of a stationary baseball for batting practice is provided. A similar, variable positioning batting tee for supporting a baseball in a stationary attitude for batting practice is seen in U.S. Pat. No. 3,489,411 issued Jan. 13, 1970, to Dominick J. Morelli, et al. While the batting tees taught by these two patents have mechanisms for x, y and z axis adjustments of a seat for the baseball to be struck, there is no teaching of actually moving the baseball while on the tee, toward the batter, just prior to striking the ball.

Additional variations on the theme of a batting tee for adjustable but static position of a baseball are taught in U.S. Pat. Nos.: 4,989,866, issued Feb. 5, 1991 to David N. Dill; 5,004,234 issued Apr. 2, 1991, to Ray A. Hollis; 5,076,580 issued Dec. 31, 1991, to Johnny D. Lang; 5,662,536 issued Sep. 2, 1997 to Rodolfo Martinez; and 5,393,050 issued Feb. 28, 1995, to Anthony L. Lloyd (see FIG. 7). A batting tee with guide arms to direct the bat toward the supported ball is seen in U.S. Pat. No. 5,478,070 issued Dec. 26, 1995, to Howard J. Morrison, and a ball tethered to the batting tee is taught in U.S. Pat. No. 5,386,987 issued Feb. 7, 1995, to John P. Rodino, Jr. A particular flexible support for the upper portion of a batting tee, for retaining parts together without damage to the device should it be struck during a practice swing, is taught in U.S. Pat. No. 4,993,708, issued Feb. 19, 1991, to William Prosser, et al.

The prior art does not teach the present invention, which is, simply stated, an uncomplicated, powered, moveable hitting tee which approaches the player at a predetermined but rather deliberate, speed. In the moveable hitting tee of the present invention, the ball remaining on the tee as the tee enters a preplanned strike or hitting zone, where the player then takes a swing at the tee-supported ball, with his or her bat or hitting device.

None of the above inventions and patents, taken either singly or in combination, is seen to describe the instant invention as claimed.

In view of the above, there exists a need for moveable hitting tee which overcomes the above mentioned problems in the prior art. This invention addresses this need in the prior art as well as other needs, which will become apparent to those skilled in the art from this disclosure.

SUMMARY OF THE INVENTION

The powered, moveable hitting tee of the instant invention is basically made up of a vertical tee, a reciprocating, horizontally disposed rod supporting the vertical tee, and a drive assembly or mechanism that is coupled to horizontally disposed rod to move the vertical tee towards the player. Multiple embodiments are described having these above noted common elements. The particular structure that moves the vertical tee is not critical to the basic concept of the present invention. Rather, it will be apparent to those skilled in the art from this disclosure that various drive mechanisms can be made used to move the vertical tee towards the player without departing from the scope of the invention as defined in the appended claims. Furthermore, the description of the embodiments disclosed herein are provided for illustration only, and not for the purpose of limiting the invention as defined by the appended claims and their equivalents.

A moveable sled or carriage assembly movably supports the horizontally disposed rod. The drive assembly or mechanism is preferably arranged parallel to and in contact with the rod, thus frictionally engaging the rod and driving the same. In one embodiment, a motor and pulley assembly is for rotating the drive belt, which in turn moves the sled, the rod and the vertical tee. A box enclosure encloses all the components of the present invention, except for a portion of the reciprocating rod which projects from one end of the box enclosure and the vertical tee which is mounted on the free, outer end of the reciprocating rod.

In one embodiment, the rod free-end and the base of the vertical tee may be loosely frictionally interfitted together so that, should the vertical tee be accidentally struck by the hitter (this will happen often, especially when youngsters are using the invention), then it will simply fall off of the rod, without damage to any of the parts of the invention. The first embodiment may include a rather rigid lower segment and a somewhat flexible upper segment made of memory-retentive material (e.g., rubber), which will bend but not be damaged when struck accidentally by a bat. In the preferred and alternate embodiment, a coil spring is interposed between the free-end of the rod of the base to effect the same purposes and functions, thus allowing each of the components to be threadedly attached to one another and be provided with added height adjustment features. The upper end of vertical tee upper segment may be flared to support a baseball or softball. Finally, the preferred embodiment may be remotely operated by a remote control handset and receiving unit attached to the motorized drive system.

Accordingly, it is a principal object of the invention to provide a powered, moveable hitting tee which supports a ball to be hit and moves the ball toward a preplanned strike zone, the ball remaining on the tee during movement of the tee.

It is another object of the invention to provide a powered, moveable hitting tee, supported and powered to move toward a hitter at a fixed or variable speed, there further being a provision for differing fixed or variable speeds.

It is a further object of the invention to provide a powered, moveable hitting tee which movement may be remotely controlled by a handset.

Still another object of the invention is to provide a powered, moveable hitting tee including a horizontally moveable and powered sled or carriage assembly located within a box enclosure, with the moveable tee extended beyond the box to a first position, farthest from the box, and then moveable toward the box, there being an imaginary strike zone defined just beyond one end of the box.

It is still an additional object of the invention to provide a powered, moveable hitting tee which is designed and configured to move a tee-mounted ball toward a hitter and a strike zone, the speed of movement being variable for different player skill levels, the invention being particularly useful in training youngsters to keep an eye on the ball as the ball approaches a strike zone.

It is an object of the invention to provide a powered, moveable hitting tee which may be remotely controlled by electrical signal, with or without an acoustic actuator activated by voice command, the motor for moving the tee being battery-powered or house-current powered, there being a friction-drive belt and rod or chain and sprocket arrangement for powering the moveable hitting tee.

It is an object of the invention to provide improved elements and arrangements thereof in an apparatus for the purposes described which is inexpensive, dependable and fully effective in accomplishing its intended purposes.

These and other objects, features, aspects and advantages of the present invention will become readily apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

Similar reference characters denote corresponding features consistently throughout the attached drawings.

DETAILED DESCRIPTION OF THE PREFERRED EMBODIMENTS

The present invention is a moveable, powered hitting tee intended for training youngsters or other athletes in the fine art of accurately striking a ball with a striking implement, such as a bat, racket or even one's hand. This invention is especially useful in training a player to hit a ball with a bat, which is considered by many as one of the most difficult endeavors in all of sports. A key discipline in learning the skill of striking a round ball with a round bat is to keep an eye on the ball as the ball is hurled into the imaginary strike zone over home plate, next to the batter.

Prior art batting or hitting tees are mainly simple stationary devices and cannot assist in the training of the baseball novice in keeping his or her eye on the moving ball. The exception noted above of an air-stream supported ball. Although the airstream supported ball is useful in providing ball movement emulating a curve ball, a sinker and other pitching movements, nevertheless, it does not provide for the guided movement of a tee supported ball into the striking or hitting zone, which movement may be done at a rather slow speed, if desired, to help train the batter in the fine art of keeping an eye on the ball.

Figure 1:
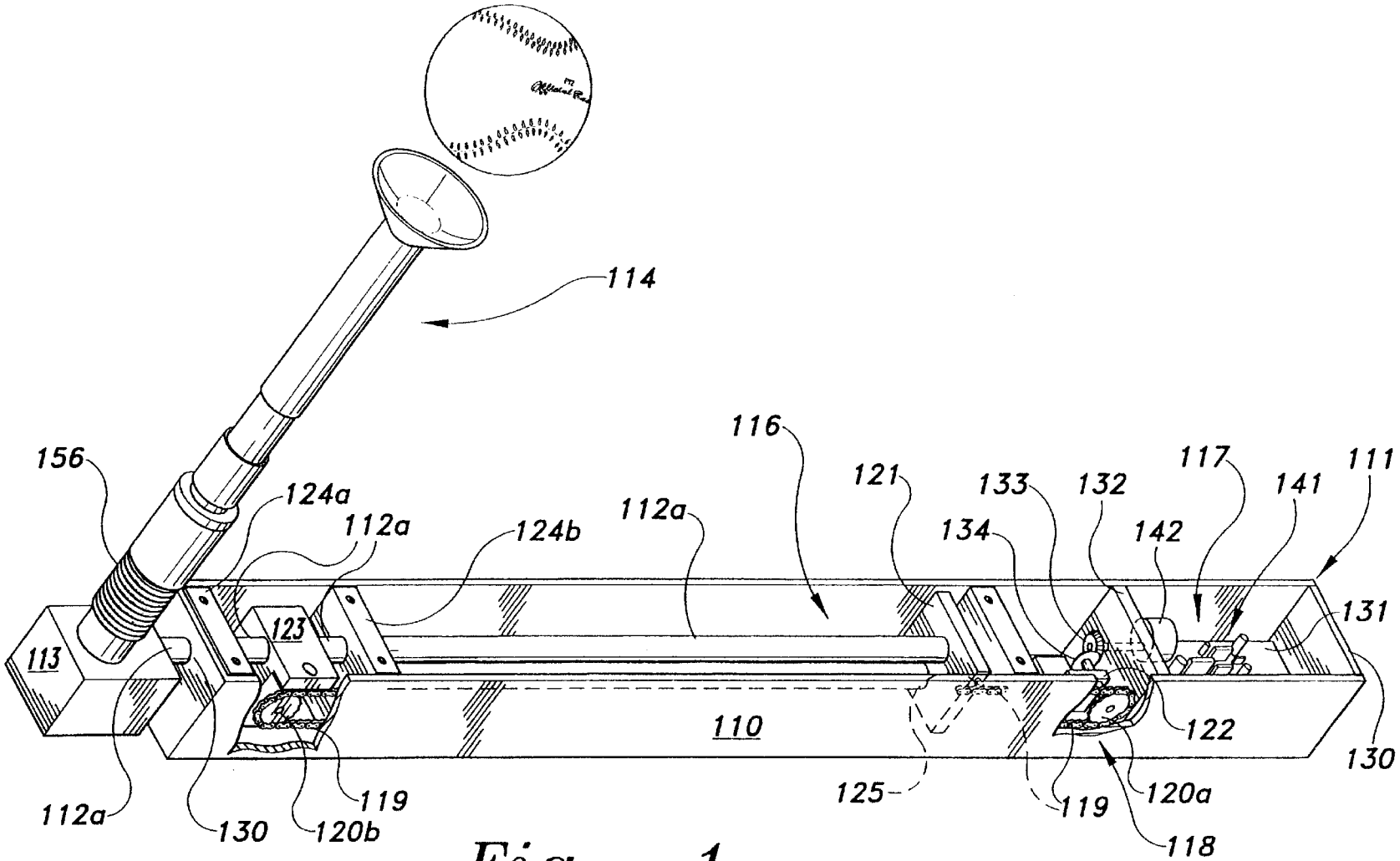
FIG. 1 is a perspective view of a preferred embodiment of the invention, with certain parts being broken away or removed to reveal interior detail, and with the hitting tee being fully retracted to a position within an imaginary strike zone.
Figure 7:
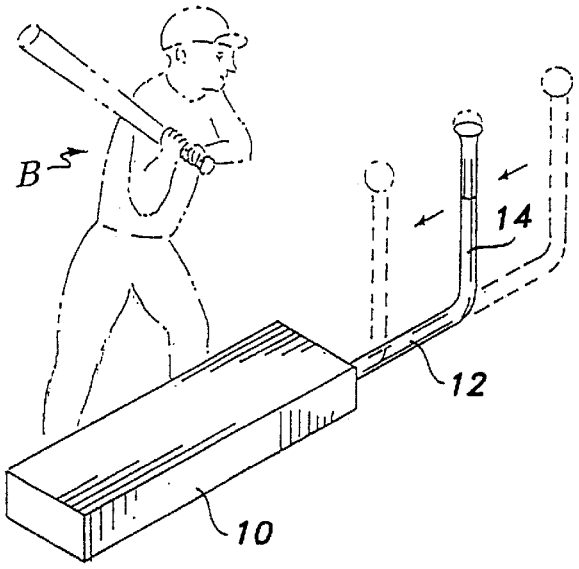
FIG. 7 is a largely diagrammatic, environmental perspective view of the alternative embodiment illustrated in FIGS. 6 and 7 showing movement of the powered hitting tee toward a hitter.
Figure 8:
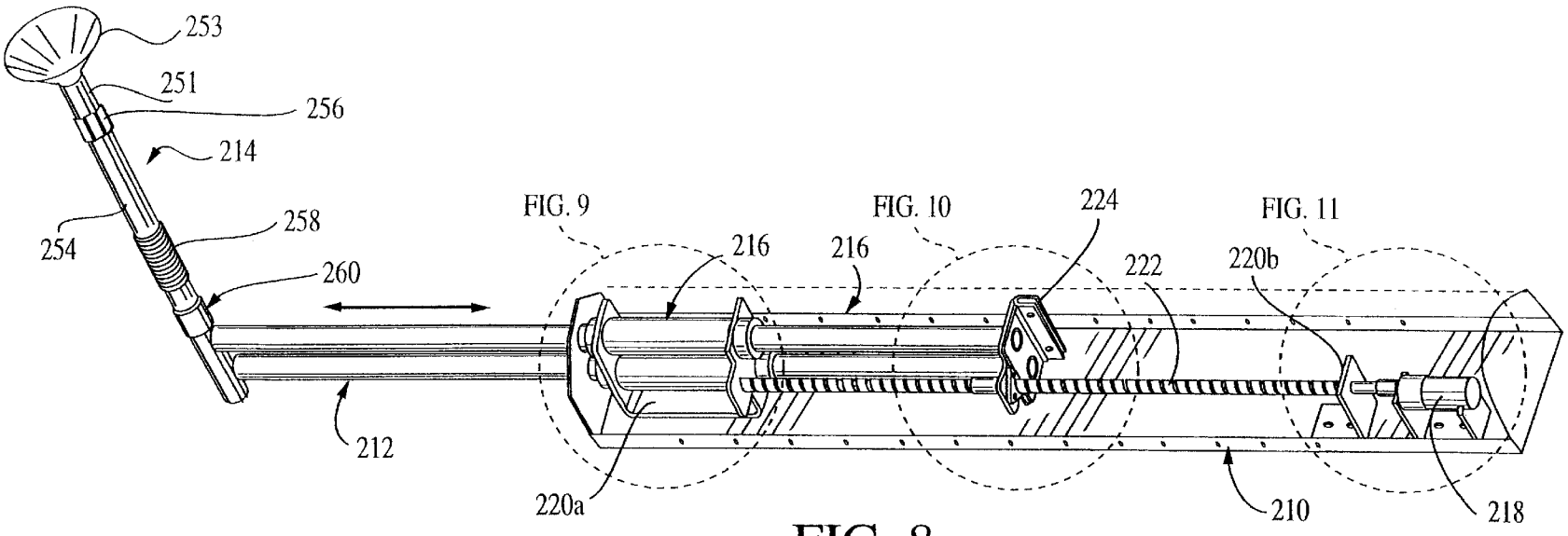
FIG. 8 is a perspective view of an alternative embodiment of the present invention, with certain parts being broken away or removed to reveal interior detail, and with the hitting tee being partially retracted towards a position within an imaginary strike or hitting zone.
Figure 10:
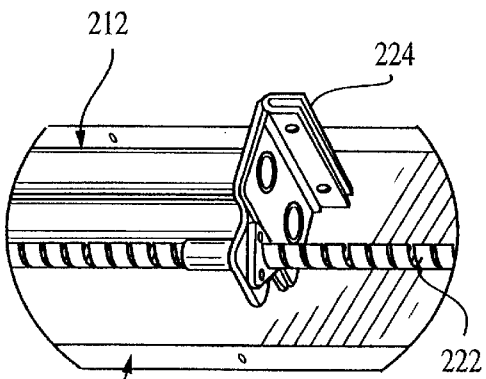
FIG. 10 is a perspective view of a portion of the alternative embodiment of the present invention, which is illustrated in FIG. 8.
Figure 9:
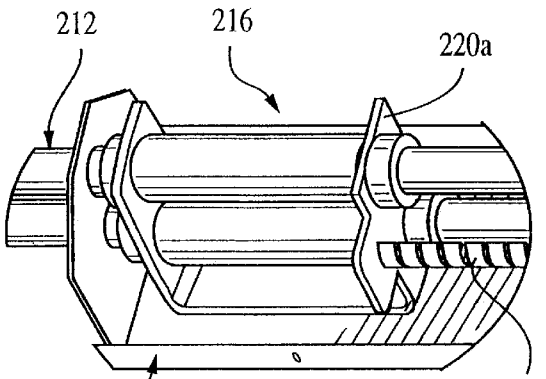
FIG. 9 is a perspective view of a portion of the alternative embodiment of the present invention, which is illustrated in FIG. 8.
Figure 11:
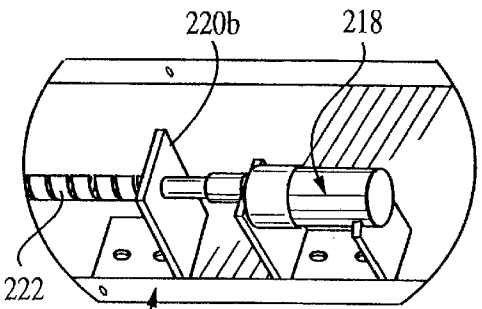
FIG. 11 is a perspective view of a portion of the alternative embodiment of the present invention, which is illustrated in FIG. 8.

With reference now to the several drawings by reference character to describe the common functional features of the present invention, FIG. 7 will be described first, followed by the three different embodiments of the powered moveable hitting tees as primarily shown in FIGS. 1, 5 and 8. With particular reference to FIG. 7, there is shown a batter B who is practicing batting with the aid of the instant invention, the batter being right-handed in this particular illustration. It should be noted here that the batter may be left-handed and no modification of the invention whatsoever is required for accommodating left-handed batters. In any event, there is provided a box enclosure 10 from which extends a horizontally disposed drive and support rod 12, which has the moveable hitting tee 14 part of the invention mounted to extend vertical therefrom as shown. Components internal to the box 10 are arranged and configured to extend the moveable tee 14 to a point of maximum separation from the box 10, as indicated by dashed lines at the right hand side of FIG. 7, and then to move the tee 14 toward the batter B's strike zone, as indicated at the immediate right-hand side of the box 10. (The strike zone itself is not illustrated in order to enhance the clarity of the rest of the view).

Figure 5:
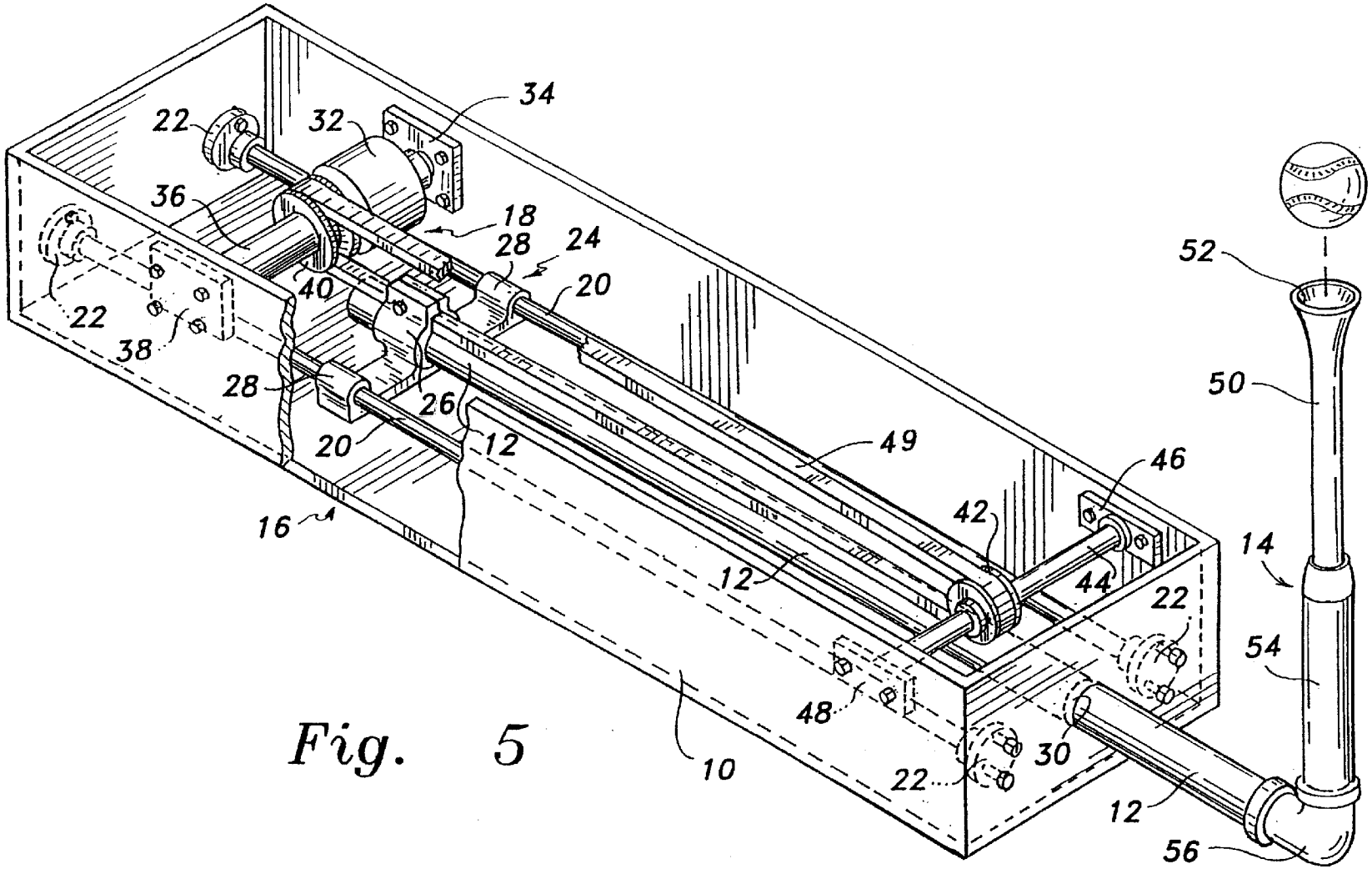
FIG. 5 is a perspective view of an alternative embodiment of the invention, with certain parts being broken away or removed to reveal interior detail, and with the hitting tee being fully retracted to a position within an imaginary strike zone.
Figure 6:
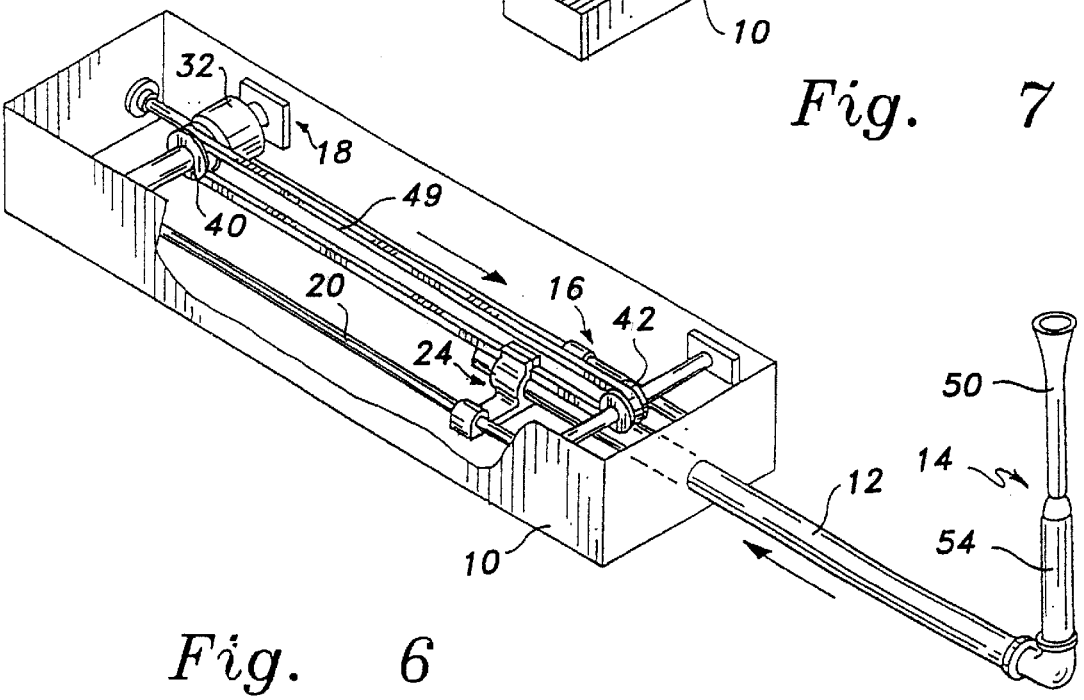
FIG. 6 is a perspective view, similar to FIG. 5, of the alternative embodiment illustrated in FIG. 5, but drawn to a reduced scale and depicting the hitting tee in a position fully extended from the box which encloses the power components for the moveable hitting tee.

Turning first to the embodiment of FIGS. 5–7, the box enclosure or stationary support 10 has a moveable member or drive rod 12 moveably coupled thereto. The moveable support tee 14 is fixedly coupled to one end of drive rod 12 for movement therewith. The box enclosure or stationary support 10 houses the two main support and drive components of the invention, these including a reciprocating sled or carriage assembly 16 and a drive motor, pulley and belt subassembly 18, which together forms a horizontal drive assembly.

The particular structure of the horizontal drive assembly that moves the vertical support tee 14 is not critical to the basic concept of the present invention. Rather, it will be apparent to those skilled in the art from this disclosure that various drive assemblies or mechanisms can be made used to move the vertical tee 14 towards the player without departing from the scope of the invention as defined in the appended claims. Furthermore, the description of the embodiments disclosed herein are provided for illustration only, and not for the purpose of limiting the invention as defined by the appended claims and their equivalents. Examples of drive assemblies or mechanisms can be used to move the vertical tee 14 towards the player includes, but is not limited to, vacuum drives, pneumatic drives, mechanical drives, magnetic drives, etc. Some more specific examples of drive assemblies or mechanisms are discussed and illustrated herein. Other drive assemblies or mechanisms contemplated by the appended claims includes, but is not limited to, a cable operated drive, a rack and pinion drive, a fluid operated cylinder drive, a spring drive, and a pneumatic drive.

Sled assembly 16 is made up of a pair of fixed, stationary slide rails or rods 20, which are mounted to the respective end walls of box 10 by suitable brackets 22, and a slide 24 which is fixedly coupled to the interior end of drive rod 12 at 26. Slide 24 includes outrigger guides 28, encircling respective rods 20 to slide therealong. Guides 28 may include interior anti-friction pads or bearings (not shown) made of PTFE or the like. Alternatively, the rails and/or guides may be lubricated. Support for the outer end of drive rod 12 is provided at opening 30 defined through an end wall of box 10. The opening 30 may also be provided with suitable anti-friction pads, bearings or lubrication. In any event, it is clearly appreciated that the assembly 16 supports the drive and support rod 12 for controlled, reciprocating movement back and forth with respect to the box 10.

Drive motor, pulley and belt subassembly 18 includes an uncomplicated electric motor 32 (e.g., AC or DC type, 110 volt or, preferably, battery powered) mounted to a side wall of box 10 by a bracket 34. Electric motor 32 includes an output or drive shaft 36, which in turn has an outer end rotatably received in a suitable bracket 38. A drive pulley 40 is affixed to shaft 36 for rotation therewith. Oppositely disposed in box 10 is a slave pulley 42 mounted for rotation on an idler shaft 44, which is fixed in blocks 46 and 48 to the opposed interior walls of box 10, as shown. Alternatively, of course, slave pulley 42 may be fixed to shaft 44 and the opposed ends of shaft 44 may be mounted in blocks 46 and 48, which would be bearing blocks, on opposed interior walls of box 10. Interconnecting the two pulleys is an endless drive belt 49, which is clamped to slide 24 at 26.

The operation of the invention is now readily appreciated. Operation of motor 32 causes rod 12 to be fully extended and moves the hitting tee 14 to the first position above explained. Reverse operation of motor 32 causes rod 12 to be drawn into box 10, and thus, moves the hitting tee 14 to the second position, again fully explained above. Movement of the rod 12 into box 10 is appreciated from an inspection of FIG. 2.

Focusing now on the hitting tee of this embodiment, hitting tee has an upper segment 50, with an outwardly flared upper end 52 that receive a baseball or softball. The upper end 52 is preferably made of suitable memory-retentive material so as to return to its original configuration after being struck by a bat, an expected, regular occurrence. Segment 50 is seated in base segment 54, which is joined by elbow 56 to drive rod 12. In an alternative embodiment, the junction of elbow 56 with rod 12 is a friction-fit only, so that when a bat unintentionally strikes tee 14, the whole tee simply falls of rod 12 and the operative components of the invention will not be damaged. As alternatives, segment 50 might be friction-fit into base 54, and/or segment 54 may be friction-fit into elbow 56. Various combinations of friction-fit assemblage are envisioned, and the scale of hitting tee components illustrated may be varied or parts deleted. For example, segment 50 could be much longer or shorter than shown, or extend down into elbow 56, base segment 54 thus being eliminated.

Turning now to the operation of motor 32 to effect operation of the moveable tee 14, motor 32 may be provided with features which vary the speed of movement of tee 14 toward the hitter. These features may include fast, medium or slow speeds, to accommodate different skill levels or ages, slow for youngster and fast for high school students, for example. Or, speed may be varied within a single movement; movement of tee 14 might start slowly and then be accelerated toward the end as the tee enters a strike zone. Also, operation of motor 32 might be done via provision of a control box hard wired to motor 32 or remotely controlled without wiring as exemplified by handset 144 of the other embodiment. These variations per se are well known to those of ordinary skill in the relevant arts and need not be detailed here.

While a drive belt and pulley arrangement for movement of rod 12 has been disclosed, other drives could be employed as mentioned above, without departing from the scope of the invention.

Embodiment of FIGS. 1–4

Referring now to FIGS. 1–4, a second embodiment of the present invention is illustrated. This embodiment is similar to the prior embodiment, discussed above, except that drive assembly of this embodiment has been modified. In view of the similarities between this embodiment and the prior embodiment, the powered hitting tee of this embodiment will not be discussed in as much detail. Rather, it will be apparent to those skilled in the art from this disclosure that the various parts and descriptions of the prior embodiments apply to the similar or identical parts of this embodiment.

In this embodiment of FIGS. 1–4, the box enclosure or stationary support 110 has a pair of horizontally disposed drive rods (moveable member) 112*a* and 112*b* (partially hidden in places) moveably coupled thereto. The moveable support tee 114 is fixedly coupled to one end of drive rods 112*a* and 112*b* by a mounting block 113 for movement therewith. The mounting block 113 has a bore into which a moveable hitting tee assembly 114 of the invention is mounted to extend vertical therefrom, as shown. The box enclosure or stationary support 110 houses the two main support and drive components of the invention, these including a reciprocating sled or carriage assembly 116 and a drive motor assembly 117, which together forms a horizontal drive assembly.

Figure 2:
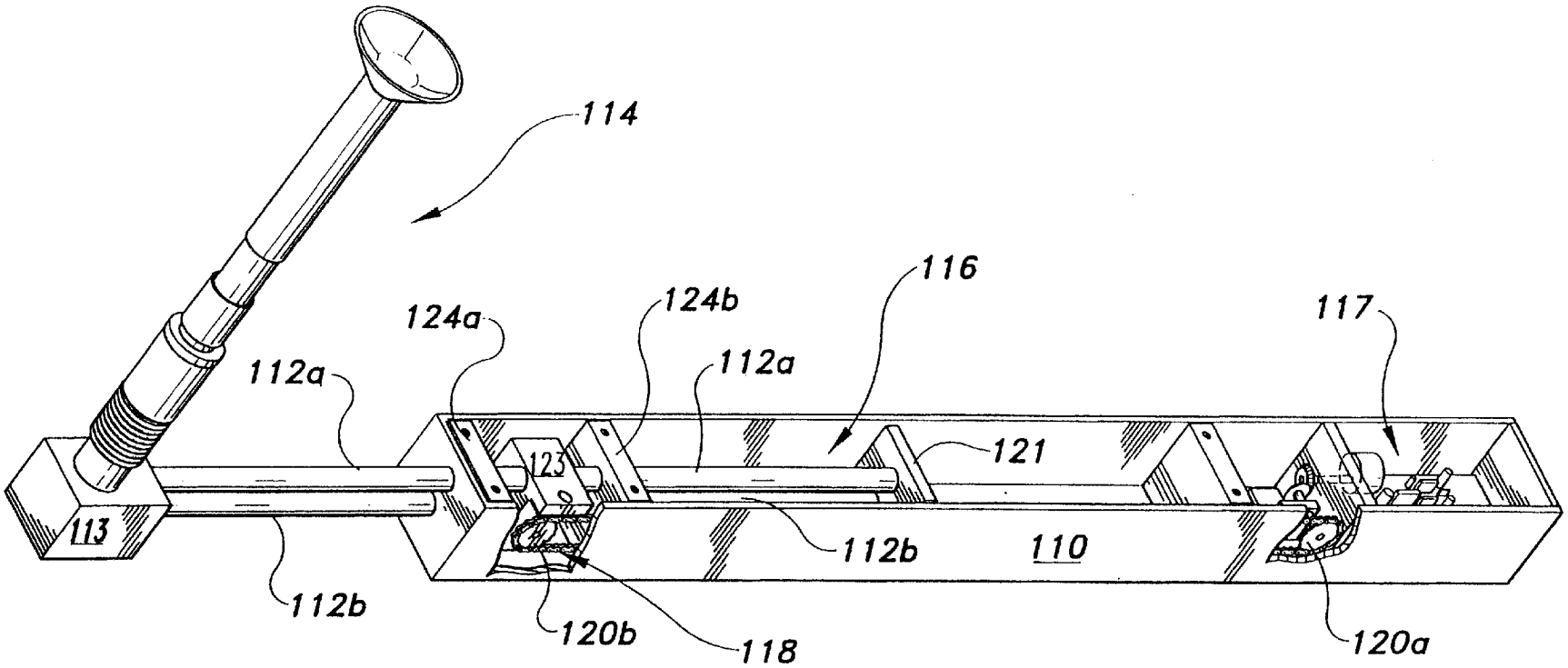
FIG. 2 is a view similar to FIG. 1, but drawn to a reduced scale and depicting the hitting tee in a position partially extended from the box which encloses the power components for the moveable hitting tee.

Components internal to the box 110 are arranged and configured to extend the moveable tee assembly 114 to any position of separation from the box 110 within a range defined by the length of the rods 112*a* and 112*b*, one such position of partial extension shown by FIG. 2. A fully retracted position is shown in FIG. 1, which, when the box 110 is positioned proximate a hitter, causes the tee assembly 114 to be moved toward the batter B's strike zone.

Like the previously discussed embodiment, the box 110 this preferred embodiment houses the two main support and drive components of the invention, these including a reciprocating sled 116 and a drive motor assembly 117 at a first end 111 of box 110. The motor assembly 117 is removably installed by means of separate removable housing plate 131, which includes an end wall 130 of box 110 and a support wall 132 to which the motor 142 is mounted. The motor 142 drives a shaft passing through support wall 132 and terminates in a bevel gear 133.

Next, unlike the prior pulley and belt subassembly embodiment, which is stationary and drives the carriage 16 along a pair of support rods 20, the sled assembly 116 is made up of the pair of rods 112*a* and 112*b*, which are mounted to a drive plate 121 at a first end interior box 110 and further mounted to mounting block 113 at the free ends exterior box 110. The rods 112*a* and 112*b* pass through a plurality of bores in support blocks 124*a* and 124*b* fixed to box 110 distal from first end 111. A chain and sprocket drive 118 is provided which drives the sled 116 in a reciprocating fashion by virtue of the chain's ability to reverse the direction of travel through a linkage with a second bevel gear 134 in turn intermeshing with bevel gear 133 of the motor assembly 117.

The chain 119 revolves in a loop about a pair of slave sprockets 120*a* and 120*b*, which are rotatably attached to a stationary pair of blocks 122 and 123 attached to box 110, the chain 119 in turn affixed by a fastener 125 to drive plate 121. Block 123 includes a pair of bores through which rods 112*a* and 112*b* of the sled 116 also pass. Each of the blocks 123, and 124*a* and 124*b* may include interior anti-friction pads or bearings (not shown) made of PTFE, nylon or the like; alternatively, the rods and/or bores may be lubricated. Further support for the outer end of drive rods 112*a* and 112*b* of sled 116 is also provided at opening 130 defined through an end wall of box 110. The opening may also be provided with suitable anti-friction pads, bearings or lubrication.

Thus, the drive and support rods 112*a* and 112*b* of sled 116 are supported for controlled, reciprocating movement back and forth with respect to the box 110. As the chain and sprocket assembly 118 is driven by the linkage between bevel gears 133,134 of the removable motor assembly 117 and chain and sprocket assembly 118, the sled 116 correspondingly moves forward or reverse by virtue of its attachment to the chain 119 at drive plate 121.

Figure 3:
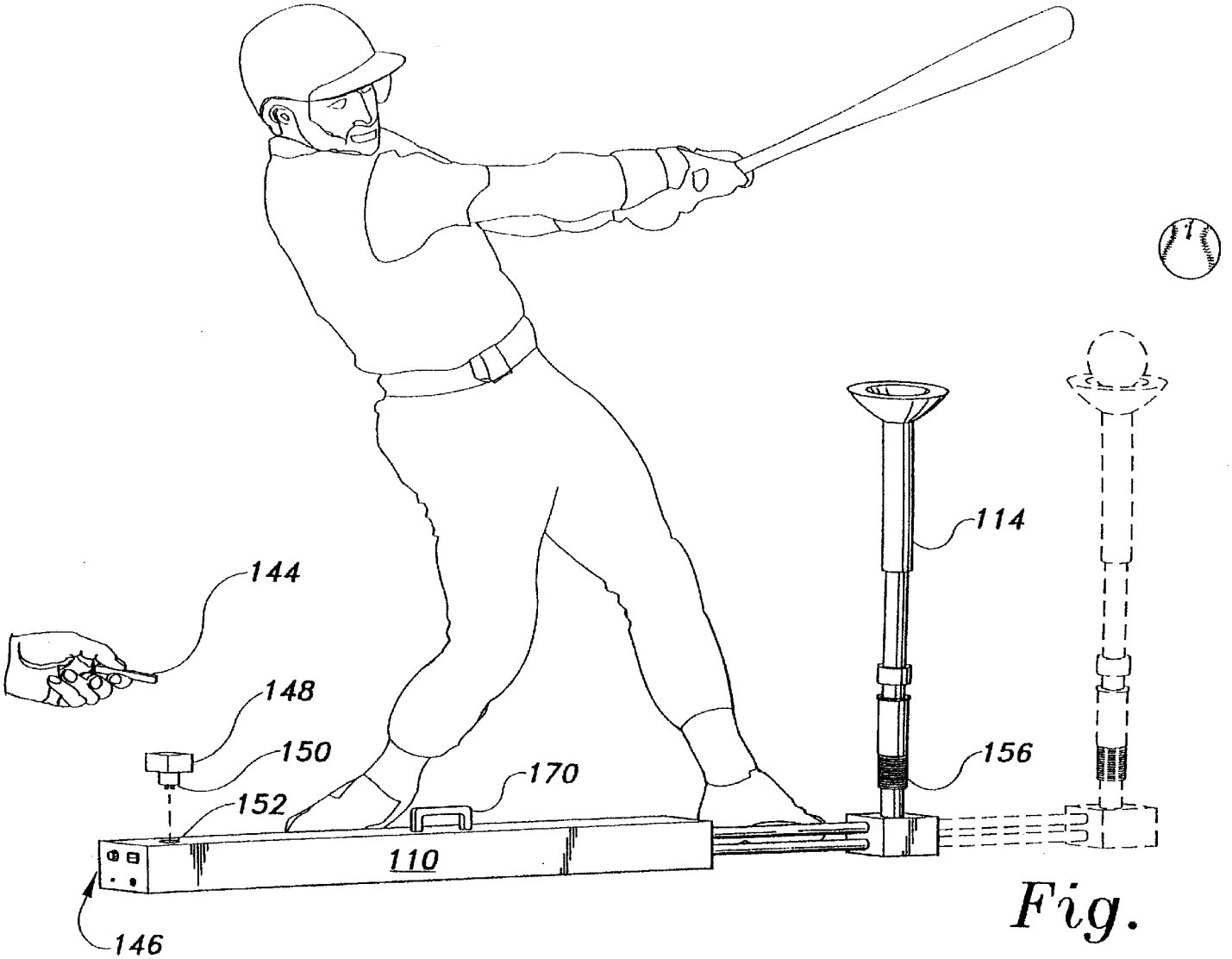
FIG. 3 is a largely diagrammatic, environmental perspective view showing movement of the powered hitting tee toward a hitter or player as controlled by a remote mechanism or means.

The drive motor assembly 117 includes an electric motor 142 and circuit board 141, which permits either direct or remote, controlled operation of the unit. As shown in FIG. 3, a remote controlled handset 144 is supplied for sending appropriate infrared or RF signals to activate a corresponding receiver in communication with the circuitry of the motor assembly 117. A pushbutton remote handset 144 having on or off and forward or reverse switches may be provided. Switches 146 are also provided exposed to the exterior of end wall 130, which switches 146 perform similar activation features but are in direct contact with the circuitry.

As an added convenience, an externally mounted, removable and rechargeable battery 148 is provided. Rechargeable battery 148 is dimensioned and configured to include a contact terminal portion 150 which passes through an opening 152 provided in a wall of the box 110 and subsequently seats onto a contact terminal of the motor assembly 117. Thus, the motor assembly 117 may be energized with a portable power source, and, when power runs low, the motor assembly 117 may receive a replacement battery allowing the first battery to be recharged. This arrangement obviates the need for tools to remove the battery 148 from the box 110, and simple manual removal of the battery 148 is sufficient. This permits transportation of the unit to non-electrified sports fields and, with multiple batteries, permits the continuous use of the invention. This feature further eliminates the need for potentially hazardous electrical cords, which may interfere with play.

Figure 4:
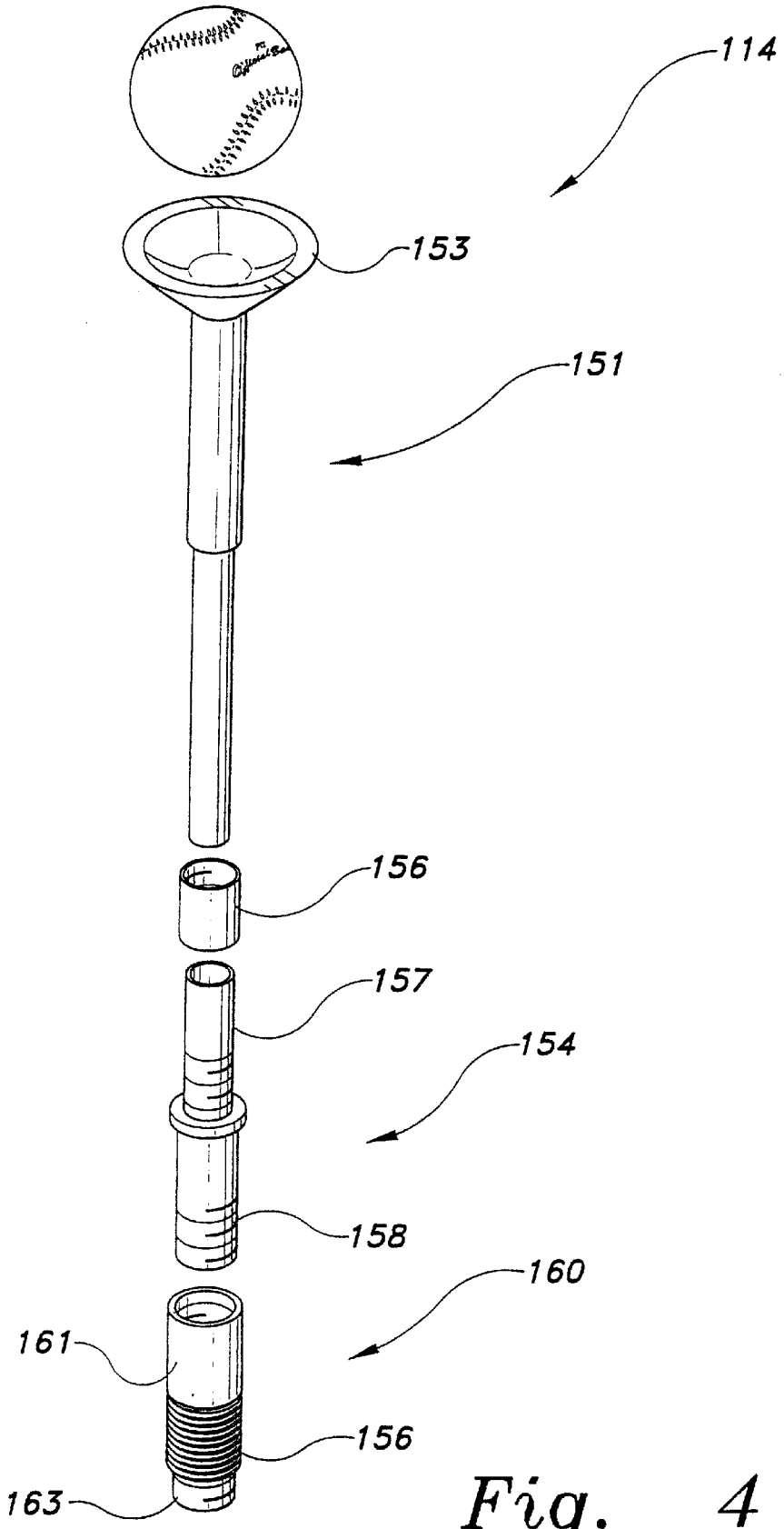
FIG. 4 is an exploded view of the tee component showing its interchangeable components.

As best seen in FIG. 4, the hitting tee 114 comprises an upper segment 151, outwardly flared at its upper end 153 to receive a ball, which flared portion may be resilient material such as rubber or plastic. Tubular rigid material, such as aluminum or other shock resistant material, may be used to construct the remainder of the upper segment 151, the materials chosen to eliminate damage thereto after being struck by a bat or other implement. Segment 151 is slidably disposed in middle segment 154 at a top end 157, which is a tubular member dimensioned and configured to receive the upper segment 151. The top end 157 includes a threaded locking collar 156, well known in the art of tubular length adjustment mechanism or means, for tightening around the upper segment 151 while it is seated at a predetermined height relative to the middle segment 154. This permits vertical height adjustment of the tee for varying height users. The middle segment 154 is in turn provided with an opposing threaded end 158 which screws into a base segment 160 which is also tubular and dimensioned and configured at its upper end 161 to receive the threaded end 158 of the middle segment 154. Additional segments (not shown) similarly threaded and uniformly sized consistent with the dimensions of the receiving ends of associated segments may be added to further extend the height of the tee portion 114 as desired.

To dampen the shock of misaimed bat strikes against the upper segment 151, the base segment 160 includes a coil spring 156 disposed between the upper end 161 and a base end 163. The base end 163 is in turn provided with a thread which screws into a matingly threaded bore of the mounting block 113 (shown in FIG. 1). The base segment 160 provides an oscillatory finction which first allows the tee to bend forward with the force of the bat strike and subsequently absorb the force energy by oscillating. The coil spring 156 is preferably chosen to have a tension which permits the tee under resting conditions to remain rigidly upright, and, prevent movement of the tee from its vertical orientation while the sled 116 is in reciprocal movement.

Turning now to the operation of motor 142 to effect operation of the moveable tee 114, motor 142 may be provided with features which include several constant speed settings, and/or several variable speed settings that vary the speed of movement of tee 114 toward the hitter. These features may include predetermined fast, medium or slow speeds (constant speed rate), to accommodate different skill levels or ages, slow for youngster and fast for high school students, for example. Or, speed may be varied within a single movement; movement of tee 114 might start slowly and then be accelerated toward the end as the tee enters a strike zone. Also, operation of motor 142 might be done via provision of a control box hard wired to motor 142 or remotely controlled without wiring as exemplified by handset 144. These variations per se are well known to those of ordinary skill in the relevant arts and need not be detailed here.

Embodiment of FIGS. 8–11

Referring now to FIGS. 8–11, a third embodiment of the present invention is illustrated. This embodiment is similar to the prior embodiments, discussed above, except that drive assembly of this embodiment has been modified. In view of the similarities between this embodiment and the prior embodiments, the powered hitting tee of this embodiment will not be discussed or illustrated in as much detail. Rather, it will be apparent to those skilled in the art from this disclosure that the various parts and descriptions of the prior embodiments apply to the similar or identical parts of this embodiment.

In this embodiment, a box enclosure or stationary support 210 moveably supports a moveable member 212, which in turn is fixedly coupled to a vertically oriented support tee assembly 214. A pair of rods forms the moveable member 212. The box enclosure or stationary support 10 houses the two main support and drive components of the invention for moving moveable member 212 and support tee assembly 214. These two main support and drive components of the invention includes a reciprocating sled or carriage assembly 216 and a drive motor 218, which together forms a horizontal drive assembly.

Sled assembly or carriage assembly 216 is basically made up of a pair of stationary support members or brackets 220*a* and 220*b*, a rotating lead screw 222 rotatably coupled to support members 220*a* and 220*b* and a slide member 224 threadedly mounted on lead screw 222 for axially movement along lead screw 222. The support members 220*a* and 220*b* are fixedly mounted to the bottom wall of box 10. The support member 220*a* slidably supports the interior ends of the rods that form the moveable member 212. The support member 220*a* may include interior anti-friction pads or bearings (not shown) made of PTFE or the like. Alternatively, the support member 220*a* may be lubricated. In any event, it is clearly appreciated that the assembly 116 moveably supports the moveable member 212 for controlled, reciprocating movement back and forth with respect to the box 210.

The lead screw 222 is rotatably coupled between support members 220*a* and 220*b* so that lead screw 222 does not move axially within the box 210. One end of the lead screw 222 is fixedly coupled to the output shaft of the motor 218 for rotating the lead screw 222. Rotations of lead screw 222 cause slide member 224 to move axially along lead screw 222. Slide member 224 is fixedly coupled to the interior ends of the rods that form the moveable member 212. Accordingly, as slide member 224 moves axially along lead screw 222, the moveable member 212 is also moved in a horizontal direction.

The drive assembly (sled or carriage assembly 216 and a drive motor 218) is operatively coupled to the moveable member 212 to move the support tee assembly 214 at a predetermined speed towards a hitter. In other words, the support tee assembly 214 moves from a first position to a second position. Components internal to the box 210 are arranged and configured to extend the moveable tee assembly 214 to any position of separation from the box 210 within a range defined by the length of the moveable member 212.

The drive motor 218 is preferably an electric motor with a circuit board (not shown), which permits either direct or remote, controlled operation of the unit. Similar to the embodiment shown in FIG. 3, a remote controlled handset can be used to send an appropriate infrared or RF signals to activate a corresponding receiver in communication with the circuitry of the circuit board that is wired to the motor 218. The pushbutton remote handset having on or off and forward or reverse switches may be provided. Switches can also be provided on the exterior of end wall of the box 210. These switches perform similar activation features but are in direct contact with the circuitry. Also as in the prior embodiment, an externally mounted, removable and rechargeable battery can be provided as discussed above with respect to the prior embodirnent.

The hitting tee 214 comprises an upper segment 251, outwardly flared at its upper end 253 to receive a ball, which flared portion may be resilient material such as rubber or plastic. Tubular rigid material, such as aluminum or other shock resistant material, may be used to construct the remainder of the upper segment 251, the materials chosen to eliminate damage thereto after being struck by a bat or other implement. Segment 251 is slidably disposed in middle segment 254 at its top end, which is a tubular member dimensioned and configured to receive the upper segment 251. The top end of middle segment 254 includes a threaded locking collar 256, well known in the art of tubular length adjustment means, for tightening around the upper segment 251 while it is seated at a predetermined height relative to the middle segment 254. This permits height adjustment of the tee for varying height users. The middle segment 254 is in turn provided with an opposing threaded end which screws into a base segment 260 which is also tubular and dimensioned and configured at its upper end to receive the threaded end of the middle segment 254. Additional segments (not shown) similarly threaded and uniformly sized consistent with the dimensions of the receiving ends of associated segments may be added to further extend the height of the tee portion 214 as desired.

To dampen the shock of a bat striking against the upper segment 251, the middle segment 254 includes a coil spring or other resilient component 258, which is disposed between its upper end and its base end. The resilient component 258 provides an oscillatory function which first allows the tee to bend forward with the force of the bat strike and subsequently absorb the force energy by oscillating. The coil spring or other resilient component 258 is preferably chosen to have a tension which permits the tee under resting conditions to remain rigidly upright, and, prevent movement of the tee from its vertical orientation while the sled 216 is in reciprocal movement.

Turning now to the operation of motor 218 to effect operation of the moveable tee 214, motor 218 may be provided with features which include several constant speed settings, and/or several variable speed settings that vary the speed of movement of tee 214 toward the hitter. These features may include predetermined fast, medium or slow speeds (constant speed rate), to accommodate different skill levels or ages, slow for youngster and fast for high school students, for example. Or, speed may be varied within a single movement; movement of tee 214 might start slowly and then be accelerated toward the end as the tee enters a strike zone. Also, operation of motor 218 might be done via provision of a control box hard wired to motor 218 or remotely controlled without wiring as exemplified by the handset 144 of the prior embodiment. These variations per se are well known to those of ordinary skill in the relevant arts and need not be detailed here.

It is envisioned that leagues of moveable tee-ball players might be established; to that end, box 10, 110 and 210 might be equipped with a carrying handle 170 (shown only in FIG. 3 with reference to this embodiment) for displacement of the entire device away from home plate when a game is played. Furthermore, it is envisioned that the box portion could be buried in a permanent installation, with a trench dug to accommodate the movement of rod 12 or, probably more likely, with rod 12 reconfigured so as to move above the ground surface.

By now it is readily appreciated that the instant invention provides an entirely new meaning and definition to the art term "tee ball." The far more realistic presentation of ball to batter provided by a ball actually moving toward the batter and strike zone will greatly enhance training of the new ball player and provide a new horizon of practice for the seasoned player. The invention may be used to train players or be a part of tee ball play. The invention is uncomplicated in structure so that it may withstand use to the point of abuse, without malfunction.

While several embodiment have been chosen to illustrate the present invention, it will be apparent to those skilled in the art from this disclosure that various changes and modifications can be made herein without departing from the scope of the invention as defined in the appended claims. For example, the particular structure that moves the vertical tee is not critical to the basic concept of the present invention. Rather, it will be apparent to those skilled in the art from this disclosure that various drive mechanisms can be made used to move the vertical tee towards the player without departing from the scope of the invention as defined in the appended claims. Furthermore, the foregoing description of the embodiments according to the present invention are provided for illustration only, and not for the purpose of limiting the invention as defined by the appended claims and their equivalents.

We claim:

1. A moveable hitting tee for supporting a ball, comprising:

a stationary support with a moveable member coupled thereto for movement from a first position to a second position;

a vertically oriented support tee coupled to said moveable member, said support tee having an upper end that is adapted to support a ball a predetermined distance above a ground surface; and a reciprocating drive assembly operatively coupled to said moveable member to move said support tee at a predetermined speed towards a hitter and in a reverse direction away from the hitter.

2. The moveable hitting tee according to claim 1, wherein said stationary support further a box enclosure with opposed end walls;

said moveable member having a first end disposed within said box enclosure and a second end extending outwardly from one of said end walls, with said support tee being mounted on said second end; and said drive assembly includes a slidably mounted carriage coupled to said first end box to first end of said moveable member.

3. The moveable hitting tee according to claim 2, wherein said drive assembly further includes a drive member operatively coupled to said carriage.

4. The moveable hitting tee according to claim 3, wherein said drive member includes a lead screw with a motor coupled thereto.

5. The moveable hitting tee according to claim 3, wherein said drive member includes a pair of rotating members and an endless loop member engaged with said rotating members to move said carriage, one of said rotating members being operatively coupled to a motor.

6. The moveable hitting tee according to claim 3, wherein said drive assembly further includes a battery electrically coupled to said drive member.

7. The moveable hitting tee according to claim 6, further comprising a remote controller operatively coupled to said drive assembly.

8. The moveable hitting tee according to claim 1, wherein said support tee comprises at least two telescopic tubular sections with a locking member releasably coupling said telescopic tubular sections together to at various heights.

9. The moveable hitting tee according to claim 1, wherein said support tee includes a force dampening portion that permits angular displacement of said support tee from a vertical position for minimizing the impact of a striking implement with said support tee.

10. The moveable hitting tee according to claim 9, wherein said force dampening portion includes a coil spring.

11. The moveable hitting tee according to claim 1, wherein said drive assembly includes a pair of rotating members and an endless loop member engaged with said rotating members to move said moveable member, and one of said rotating members being operatively coupled to a motor.

12. A moveable hitting tee for supporting a ball comprising:

a stationary support with a moveable member coupled thereto for movement from a first position to a second position;

a vertically oriented support tee coupled to said moveable member, said support tee having an upper end that is adapted to support a ball a predetermined distance above a sound surface; and a drive assembly operatively coupled to said moveable member to move said support tee at a predetermined speed towards a hitter, said drive assembly including a lead screw with a motor coupled thereto.

13. A method of training a player to hit a moving ball, comprising the steps of:

supporting a ball a predetermined distance above a ground surface on a support tee; and reciprocally moving said support tee with said ball supported thereon towards and away from the player at a predetermined speed relative to the ground so as to assist in training the player to keep an eye on the ball as it is moved toward the player by said support tee, whereupon the hitter can swing at the ball as the supported ball enters a preplanned hitting zone.

14. The method of training a player to hit a moving ball according to claim 13, comprising the step of:

remotely controlling said predetermined speed of said ball and said support tee toward the player.

15. The method of training a player to hit a moving ball according to claim 13, wherein said predetermined speed of said support tee with said ball supported thereon is a relatively constant speed.

16. The method of training a player to hit a moving ball according to claim 13, comprising the step of:

said predetermined speed of said support tee with said ball supported thereon is variable such that said support tee accelerates toward the player.

17. The method of training a player to hit a moving ball according to claim 13, comprising the step of:

driving an endless loop member that is operatively coupled to said support tee to horizontally move said support tee.

18. The method of training a player to hit a moving ball according to claim 13, comprising the step of:

providing said support tee with a resilient portion that allows said support tee to bend when accidentally hit.

19. The method of training a player to hit a moving ball according to claim 13, comprising the step of:

vertically adjusting said support tee to change said predetermined distance above the ground surface that said is supported on said support tee.

20. A method of training a player to hit a moving ball, comprising the step of:

supporting a ball a predetermined distance above a ground surface on a support tee;

moving said support tee with said ball supported thereon towards the player at a predetermined speed relative to the ground so as to assist in training the plaver to keep an eye on the ball as it is moved toward the player by said support tee, whereupon the hitter can swing at the ball as the supported ball enters a preplanned hitting zone; and driving a lead screw that is operatively coupled to said support tee to horizontally move said support tee.

21. A method of hitting a moving ball, comprising the steps of:

non fixably supporting a ball on a support tee a predetermined distance above a ground surface such that the ball can be hit off the support tee; and moving said support tee with said ball supported thereon towards the player at a predetermined speed relative to the ground, whereupon the hitter can swing at the ball as the supported ball enters a preplanned hitting zone.

* * * * *